US005348827A

United States Patent [19]

Hatano

[11] Patent Number: 5,348,827

[45] Date of Patent: Sep. 20, 1994

[54] PLATE MATERIAL FOR SHADOW MASK

[75] Inventor: Tsutomu Hatano, Tokyo, Japan

[73] Assignee: Dai Nippon Printing Co., Ltd., Tokyo, Japan

[21] Appl. No.: 692,454

[22] Filed: Apr. 25, 1991

[30] Foreign Application Priority Data

Apr. 26, 1990 [JP] Japan ..... 2-111560

[51] Int. Cl.[5] ..... G03C 3/00

[52] U.S. Cl. ..... 430/11; 430/23; 420/94; 313/402

[58] Field of Search ..... 430/11, 23; 420/94; 313/402

[56] References Cited

U.S. PATENT DOCUMENTS 4,445,998 5/1984 Kanada et al. ..... 205/152

4,751,424 6/1988 Tong ..... 420/94

*Primary Examiner*—Steve Rosasco

*Attorney, Agent, or Firm*—Dellett and Walters

[57] ABSTRACT

A plate material for a shadow mask, consisting essentially of iron or of iron and nickel and having a surface configuration which stabilizes the adhesion between the plate material and a photoresist and improves the adhesion between the plate material and a negative pattern in the process of producing a shadow mask, thereby enabling improvements in the quality and the productivity, and which causes no annealing adhesion in the shadow mask softening annealing step in the process of producing a color picture tube. The plate material has a surface roughness Ra and a surface roughness projection condition Rsk, which are defined as follows:

Ra: from 0.3 to 0.8μm

Rsk: +0.1 or more where Ra is the surface roughness specified in JIS B 0601, and Rsk is a value representative of the relativity of an amplitude distribution curve to a mean line, i.e., the projection condition expressed by $$Rsk = \frac{1}{n \times jRq^3}\left\{\sum_{i=1}^{i=n\times j} Y(i)^3\right\}$$

where Y(i) is a roughness curve obtained within a reference length of a sectional curve when the mean line and the direction of vertical magnification are assumed to be the X-axis and the Y-axis, respectively; Rq is a quadratic mean roughness; n=230; and j=2 to 5.

8 Claims, 1 Drawing Sheet

PLATE MATERIAL FOR SHADOW MASK

BACKGROUND OF THE INVENTION

The present invention relates to a metallic plate material for a shadow mask used in a color picture tube, which is designed to improve the adhesion between the plate material and a photoresist and also the adhesion between the plate material and a negative pattern in the shadow mask producing process, thereby reducing the suction time required to bring the negative pattern into contact with the plate material, and thus enabling an improvement in the productivity, the plate material also permitting the negative pattern to be transferred accurately and causing no annealing adhesion in the shadow mask softening annealing step in the process of producing a color picture tube.

Hitherto, shadow masks for color picture tubes have been formed using a low-carbon, aluminum-killed, cold-rolled steel plate consisting essentially of iron or an alloy plate consisting essentially of iron and nickel, for example, a 36 nickel-iron invariable alloy plate. As to these plate materials, no precise definition of the surface roughness has been made particularly.

Since there is no precise definition of the surface roughness of the conventional plate materials for shadow masks, as stated above, the adhesion between a metallic plate material and a photoresist is likely to become unstable in the process of producing a shadow mask from the plate material used as a blank, and the adhesion between a negative pattern and the metallic plate material coated with the photoresist is also unstable in the step of transferring the negative pattern. In addition, annealing adhesion occurs in the step of subjecting the resulting shadow mask to softening annealing to give press deformability thereto in the process of producing a color picture tube, thus having adverse effects on the quality and the productivity.

SUMMARY OF THE INVENTION

In view of these circumstances, it is an object of the present invention to provide a plate material for a shadow mask, consisting essentially of iron or of iron and nickel and having a surface configuration which stabilizes the adhesion between the plate material and a photoresist and improves the adhesion between the plate material and a negative pattern in the process of producing a shadow mask, thereby enabling improvements in the quality and the productivity, and which causes no annealing adhesion in the shadow mask softening annealing step in the process of producing a color picture tube.

The present inventor conducted exhaustive studies in order to attain the above-described object and, as a result, has found that, by specifying the surface roughness Ra and surface roughness projection condition Rsk of a plate material for a shadow mask, it is possible to improve the adhesion between the plate material and a photoresist and also the adhesion between the plate material and a negative pattern, thereby reducing the suction time required to bring the negative pattern into contact with the plate material, and thus enabling an improvement in the productivity, and it is also possible to transfer the negative pattern accurately to thereby enable an improvement in the quality, and it is further possible to prevent the annealing adhesion in the shadow mask softening annealing step in the process of producing a color picture tube. The present invention has been accomplished on the basis of this finding.

More specifically, to solve the above-described problems, the present invention provides a plate material for a shadow mask, having a surface roughness Ra and a surface roughness projection condition Rsk, which are defined as follows:

Ra: from 0.3 to 0.8$\mu$m

Rsk: +0.1 or more where Ra is the surface roughness specified in JIS B 0601,and Rsk is a value representative of the relativity of an amplitude distribution curve to a mean line, i.e., the projection condition expressed by $$Rsk = \frac{1}{n \times jRq^3}\left\{\sum_{i=1}^{i=n\times j} Y(i)^3\right\}$$

where Y(i) is a roughness curve obtained within a reference length of a sectional curve when the mean line and the direction of vertical magnification are assumed to be the X-axis and the Y-axis, respectively; Rq is a quadratic mean roughness; n=230; and j=2 to 5.

Preferably, the plate material for a shadow mask consists essentially of iron or of iron and nickel.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 1(*b*) shows a roughness profile in which Rsk is −, i.e., there are many flat regions on the surface.

DESCRIPTION OF THE PREFERRED EMBODIMENTS

Figures 1A, 1B:
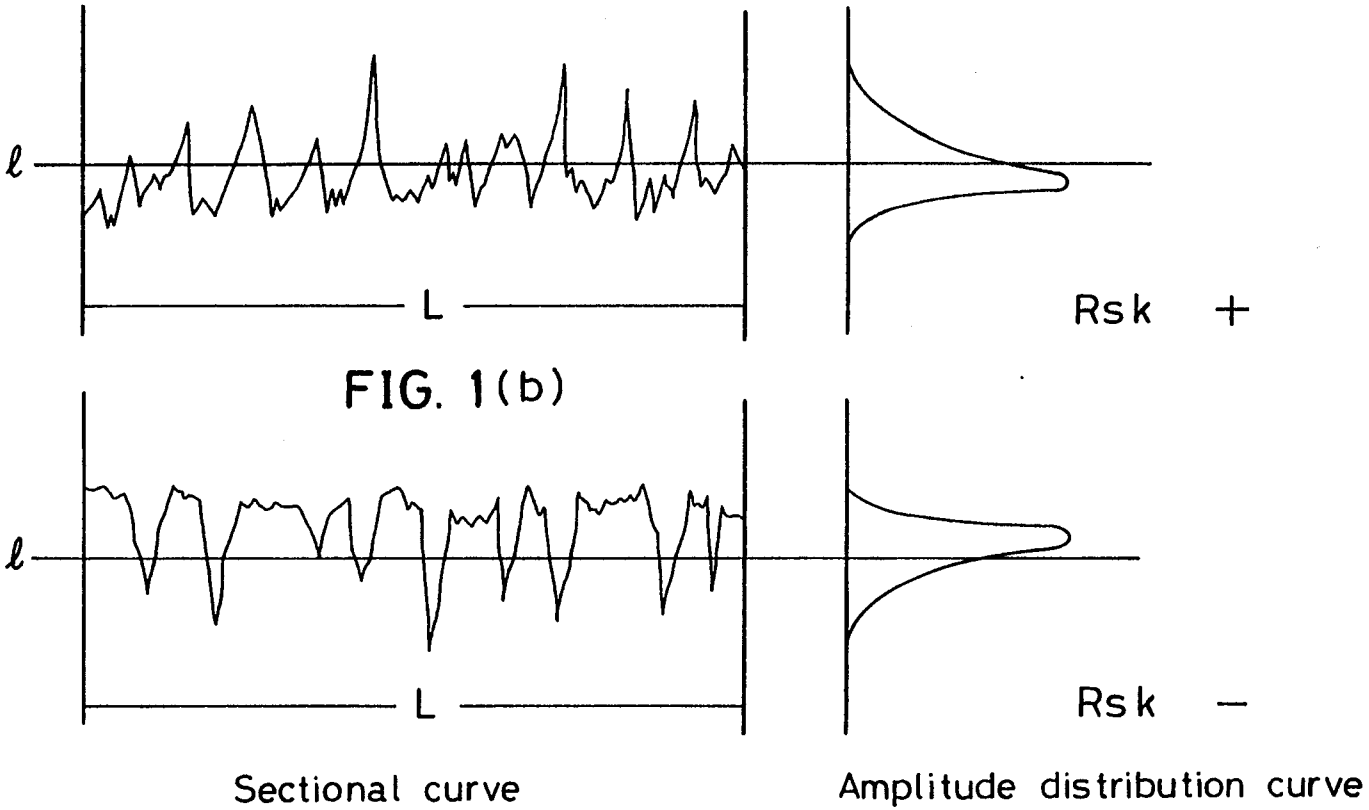
FIG. 1 illustrates the projection condition Rsk of the surface roughness: in which FIG. 1(*a*) shows a roughness profile in which Rsk is +, i.e., the roughness profile is upwards convex.

First of all, each of the above-mentioned conditions of the present invention will be described below in detail.

As a result of studies, the present inventor has found that the surface roughness Ra of a plate material for a shadow mask has large effects on the adhesion of a photoresist that is coated thereon and the adhesion between the plate material and a negative pattern. If the adhesion of the photoresist is improper, appropriate photosensitive characteristics cannot be obtained, so that holes which are etched with the photoresist used as a mask become nonuniform in shape, causing a lowering in the quality of the resulting shadow mask. If the adhesion between the plate material and the negative pattern is inferior, the suction time that is required to bring them in contact with each other lengthens, causing a lowering in the productivity. The fact that the adhesion between the plate material and the negative pattern is inferior means that the negative pattern cannot be accurately transferred, which also causes a lowering in the quality. The results of the studies reveal that the surface roughness Ra according to JIS B 0601 needs to be specified as follows: If the surface roughness Ra is smaller than 0.3μm, the adhesion between the plate material for a shadow mask and a photoresist is too weak, so that a predetermined hole shape cannot uniformly be obtained. Also, the adhesion between the plate material and a negative pattern becomes inferior, causing a lowering in the quality of the resulting shadow mask. If the surface roughness Ra is greater than 0.8μm, in the case of a circular hole pattern, the roundness is deteriorated, whereas in the case of a slot pattern, the linearity of slots is deteriorated, thus causing a lowering in the shadow mask quality in either case. Therefore, the surface roughness Ra needs to be specified in the range of from 0.3 to 0.8μm.

However, it has been revealed that the above-described designation of the surface roughness Ra alone is not sufficient to improve the productivity in the shadow mask manufacturing process, that is, to achieve a reduction in the suction time required in the step of bringing a negative pattern into contact with the plate material, and it is impossible to prevent annealing adhesion of plate materials in the shadow mask softening annealing step in the process of producing color picture tubes. Accordingly, the present inventor conducted various studies in order to solve these problems and, as a result, has found that it is important to specify the projection condition Rsk of the surface roughness. Rsk is a value representative of the relativity of an amplitude distribution curve to a mean line l of the surface roughness profile within a reference length L, as shown in FIG. 1. When Rsk is +, the roughness profile is upwards convex, which means that there are many projections on the surface, as shown in Fig. 1(*a*). Conversely, when Rsk is −, it means that there are many flat regions on the surface, as shown in Fig. 1(*b*). If there are many projections on the surface, more passages of air for suction are formed between the negative pattern and the plate material for a shadow mask in the negative pattern contacting step, so that the suction time can be shortened. If there are many projections on the surface of each plate material for a shadow mask, plates are in point contact with each other in the shadow mask softening annealing step, so that annealing adhesion is prevented. Thus, the projection condition Rsk of the surface roughness needs to be +0.1 or more.

Examples of the present invention will be explained below.

As shadow mask materials, a low-carbon, aluminum-killed, cold-rolled steel plate consisting essentially of iron and a 36 nickel-iron invariable alloy consisting essentially of iron and nickel were used. These materials were rolled to a predetermined thickness, and the surface roughness Ra and the surface roughness projection condition Rsk were adjusted by dull finish. First, each plate material was subjected to degreasing to remove the rolling mill oil and the anti-rust oil, and then both surfaces of the plate material were coated with a photoresist. After drying, a negative pattern formed with a predetermined dot-shaped pattern or a slot-shaped pattern was brought into close contact with each surface of the plate material, and then light exposure was carried out. After development, the plate material was subjected to burning treatment. Thereafter, predetermined holes were formed in the plate material by etching using a ferric chloride solution and then the remaining photoresists were removed to obtain a shadow mask. The shadow masks produced in this way were compared as to the adhesion of the photoresist in terms of the time required for the photoresist to peel off the plate material in a 35% hydrochloric acid solution. As for the adhesion to the negative pattern, comparison was made in terms of the suction time required to attain the adequate contact between each plate material and the negative pattern. As for the negative pattern transfer accuracy, comparison was made in terms of the general non-uniformity of the shadow masks.

Next, the shadow masks were compared as to the degree of annealing adhesion in the softening annealing step carried out to give press deformability thereto in the process of producing color picture tubes.

The results of the above-described investigation are shown in Table 1 below:

TABLE 1

| | No. | Ra μm | Rsk | Resist peel time (sec) | Suction time (sec) | General non-uniformity | Annealing adhesion condition |
|---|---|---|---|---|---|---|---|
| Examples | 1 | 0.35 | +0.2 | 70 | 32 | B | c |
| of | 2 | 0.40 | +0.3 | 75 | 20 | B | c |
| present | 3 | 0.50 | +0.3 | 75 | 20 | A | b |
| invention | 4 | 0.50 | +0.5 | 83 | 16 | A | b |
| | 5 | 0.55 | +0.6 | 85 | 15 | A | b |
| | 6 | 0.55 | +0.8 | 95 | 15 | A | a |
| | 7 | 0.55 | +1.0 | 110 | 12 | A | a |
| | 8 | 0.62 | +1.0 | 115 | 10 | A | a |
| | 9 | 0.73 | +0.5 | 110 | 10 | B | a |
| Comp. | 10 | 0.25 | 0.0 | 32 | 116 | E | e |
| Examples | 11 | 0.35 | −0.3 | 36 | 110 | D | e |
| | 12 | 0.55 | −0.5 | 48 | 104 | D | e |
| | 13 | 0.55 | −0.1 | 52 | 90 | C | d |
| | 14 | 0.68 | −0.3 | 60 | 82 | C | d |

TABLE 1-continued

| No. | Ra μm | Rsk | Resist peel time (sec) | Suction time (sec) | General non-uniformity | Annealing adhesion condition |
|---|---|---|---|---|---|---|
| 15 | 0.90 | −0.2 | 65 | 60 | E | c |

(Notes)
General non-uniformity:
A: excellent, no unevenness
B: excellent, substantially no unevenness
C: no problem in practical application, although a little unevenness
D: impracticable, some unevenness
E: considerably uneven
Annealing adhesion condition:
a: no adhesion
b: a little adhesion at the outer peripheral portion
c: no effect on the operating efficiency, although a little adhesion (easy to separate the adhering plate materials)
d: difficult to separate the adhering plate materials, deteriorating the operating efficiency
e: strong adhesion, impossible to separate the adhering plate materials In Table 1, Examples 1 and 2 of the present invention have a little annealing adhesion, but this degree of annealing adhesion is practically admitted without any effect on the operating efficiency. Examples 3 to 9 of the present invention are excellent not only in the evenness grade but also in the annealing adhesion condition. In particular, Examples 6 to 8 of the present invention are superior in both the general non-uniformity and the annealing adhesion condition, and these are also superior in both the adhesion of the photoresist and the adhesion to the negative pattern. Thus, in these Examples particularly excellent masks were obtained. The results of this investigation reveal that it is particularly preferable to set Ra in the range of from 0.55 to 0.65μm and Rsk at +0.7 or more.

In contrast, Comparative Examples 10 to 15 are inferior in the general non-uniformity because either or both Ra and Rsk are out of the ranges specified in the present invention, and further the annealing adhesion produces an adverse effect on the operating efficiency. These Examples 10 to 15 are therefore impracticable.

As has been detailed above, the use of the plate material for a shadow mask according to the present invention enables an improvement in the productivity in the shadow mask manufacturing process and also permits production of a shadow mask of excellent general non-uniformity. In addition, it is possible to provide a shadow mask which causes no annealing adhesion and does not deteriorate the operating efficiency in the shadow mask softening annealing step in the process of producing a color picture tube.

What we claim is:

1. A plate material for a shadow mask used in a color picture tube, having a surface roughness Ra and a surface roughness projection condition Rsk, which are defined as follows:

Ra: from 0.3 to 0.8μm

Rsk: +0.1 or more where Ra is the surface roughness specified in JIS B 0601, and Rsk is a value representative of the relativity of an amplitude distribution curve to a mean line, i.e., the projection condition expressed by $$Rsk = \frac{1}{n \times jRq^3}\left\{\sum_{i=1}^{i=n\times j} Y(i)^3\right\}$$

where Y(i) is a roughness curve obtained within a reference length of a sectional curve when the mean line and the direction of vertical magnification are assumed to be the X-axis and the Y-axis, respectively; Rq is a quadratic mean roughness; n=230; and j=2 to 5.

2. A plate material for a shadow mask according to claim 1, which consists essentially of iron or of iron and nickel.

3. A plate material for a shadow mask according to claim 2, wherein said surface roughness Ra and said surface roughness projection condition Rsk are within the following ranges:

Ra: 0.55 to 0.65 μm

Rsk: +0.7 or more.

4. A shadow mask which is formed from the plate material defined in claim 3.

5. A shadow mask which is formed from the plate material defined in claim 2.

6. A plate material for a shadow mask according to claim 1, wherein said surface roughness Ra and said surface roughness projection condition Rsk are within the following ranges:

Ra: 0.55 to 0.65μm

Rsk: +0.7 or more.

7. A shadow mask which is formed from the plate material defined in claim 6.

8. A shadow mask which is formed from the plate material defined in claim 1.

* * * * *